US007776111B2

(12) United States Patent
Krull et al.

(10) Patent No.: US 7,776,111 B2
(45) Date of Patent: Aug. 17, 2010

(54) MINERAL OILS WITH IMPROVED CONDUCTIVITY AND COLD FLOWABILITY

(75) Inventors: Matthias Krull, Harxheim (DE); Carsten Cohrs, Burghausen (DE); Hildegard Freundl, Burgkirchen (DE); Stefan Lorenz, Frankfurt am Main (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 589 days.

(21) Appl. No.: 11/185,387

(22) Filed: Jul. 20, 2005

(65) Prior Publication Data

US 2006/0020065 A1 Jan. 26, 2006

(30) Foreign Application Priority Data

Jul. 20, 2004 (DE) ..... 10 2004 035 157

(51) Int. Cl.
*C08K 5/41* (2006.01)

(52) U.S. Cl. ..... 44/300; 44/370; 44/412; 44/418; 44/435; 516/25; 562/30; 562/33; 208/15; 208/19

(58) Field of Classification Search ..... 585/14; 208/19, 177; 508/475, 545, 551; 44/370, 44/393, 412, 418, 435, 440; 516/25, 58; 562/30, 33

See application file for complete search history.

(56) References Cited

U.S. PATENT DOCUMENTS

| | | | | | |
|---|---|---|---|---|---|
| 2,542,012 | A | * | 2/1951 | Keiser et al. | 516/184 |
| 3,578,422 | A | * | 5/1971 | Dorer | 44/331 |
| 3,850,587 | A | | 11/1974 | Frost, Jr. | |
| 3,917,466 | A | | 11/1975 | Henry, Jr. | |
| 4,116,644 | A | * | 9/1978 | Jackisch et al. | 44/370 |
| 4,211,534 | A | | 7/1980 | Feldman | |
| 4,356,002 | A | | 10/1982 | Knepper | |
| 4,425,249 | A | * | 1/1984 | Cahill et al. | 508/412 |
| 4,670,516 | A | | 6/1987 | Sackmann | |
| 5,039,437 | A | * | 8/1991 | Martella et al. | 508/572 |
| 5,082,470 | A | * | 1/1992 | Martella et al. | 44/304 |
| 5,089,589 | A | | 2/1992 | Hesse | |
| 5,118,432 | A | * | 6/1992 | Emert et al. | 508/189 |
| 5,391,632 | A | | 2/1995 | Krull | |
| 5,707,946 | A | | 1/1998 | Hiebert | |
| 5,851,429 | A | | 12/1998 | Magyar | |
| 5,889,137 | A | | 3/1999 | Hutchings | |
| 5,998,530 | A | | 12/1999 | Krull | |
| 6,071,993 | A | | 6/2000 | Wenderoth et al. | |
| 6,232,277 | B1 | | 5/2001 | Ledeore | |
| 6,362,275 | B1 | * | 3/2002 | Mani et al. | 524/841 |
| 2001/0034390 | A1 | | 10/2001 | Okubo et al. | |
| 2004/0065004 | A1 | * | 4/2004 | Krull et al. | 44/601 |

FOREIGN PATENT DOCUMENTS

| | | |
|---|---|---|
| CA | 2017126 | 11/1990 |
| DE | 19622052 | 12/2000 |
| EP | 0311452 | 4/1989 |
| EP | 1134268 | 9/2001 |
| EP | 1502938 | 2/2005 |

OTHER PUBLICATIONS

Nicholas P. Cheremisinoff, Polymer Characterization: Laboratory Techniques and Analysis, 1996, 1st edition, Appendix D, p. 152.*
Lewis, R.J. (1997). Hawley's Condensed Chemical Dictionary, 13th ed. Wiley.*
Hann, W.M. (1993). "Dispersants," in Kirk-Othmer Encyclopedia of Chemical Technology, 4th ed., vol. 8, Wiley, pp. 293-311.*
Reznikov, V.D. et al. (1980). Chemistry and Technology of Fuels and Oils, 16(10), 661-664.*
Karzhev, V.I. et al. (1976). Chemistry and Technology of Fuels and Oils, 12(9), 702-705.*
Roempp Chemie Lexikon, 9 Ed., (1988-92), vol. 4, pp. 3351-3354.
European Patent Office, European Search Report, Aug. 14, 2009, 7 pgs., Europe.

* cited by examiner

*Primary Examiner*—Robert J Hill, Jr.
*Assistant Examiner*—Brian McCaig
(74) *Attorney, Agent, or Firm*—Tod A. Waldrop

(57) ABSTRACT

The invention provides compositions comprising at least one alkylphenol-aldehyde resin (constituent I) and, based on the alkylphenol resin, from 0.005 to 10% by weight of at least one oil-soluble organic ammonium sulfonate (constituent II).

31 Claims, No Drawings

MINERAL OILS WITH IMPROVED CONDUCTIVITY AND COLD FLOWABILITY

In the face of increasingly strict environmental legislation, the content of sulfur compounds and aromatics in mineral oil distillates is having to be reduced ever further. However, in the refinery processes used to prepare on-spec mineral oil qualities, other polar and aromatic compounds are simultaneously also removed. As a side effect, this greatly reduces the electrical conductivity of these middle distillates. As a result of this, electrostatic charges, as occur especially under high flow rates, for example in the course of pumped circulation in pipelines and filters in the refinery, in the distribution chain and in the consumer's equipment, cannot be dissipated. However, such potential differences between the oil and its environment harbor the risk of spark discharge which can lead to self-ignition or explosion of the highly inflammable liquids. Additives which increase the conductivity and ease the potential disipation between the oil and its environment are therefore added to such oils having low electrical conductivity.

One compound class used for various purposes in mineral oils is that of alkylphenol resins and derivatives thereof which can be prepared by condensation of alkylphenols with aldehydes under acidic or basic conditions. For example, alkylphenol resins are used as cold flow improvers, corrosion inhibitors and asphalt dispersants, and alkoxylated alkylphenol resins as demulsifiers in crude oils and middle distillates. In addition, alkylphenol resins are used as stabilizers for jet fuel. However, the action of the known resins and of the additive systems comprising them is not yet satisfactory, especially in many low-sulfur or sulfur-free oils.

GB-A-2 305 437 and GB-A-2 308 129 disclose alkylphenol-formaldehyde resins as pour point depressants for wax-containing liquids such as diesel, lubricant oil, hydraulic oil, crude oils. The condensation of the alkylphenols with formaldehyde in a ratio of from 2:1 to 1:1.5 may be carried out in the presence of acidic catalysts such as sulfuric acid, sulfonic acids or carboxylic acids. The resin may subsequently be treated with NaOH if required in order to convert the acidic catalyst to the sodium salt and to remove it, for example, by filtration. In the examples, concentrated sulfuric acid is used and is filtered off after the condensation as the sodium salt.

EP-A-0 857 776 discloses the use of alkylphenol resins in combination with ethylene copolymers and nitrogen-containing paraffin dispersants for improving the cold properties of middle distillates. The resins can be condensed under catalysis by inorganic or organic acids, which in some cases remain in the product after neutralization which is not specified further. In the examples, the resins are condensed with catalysis by alkylbenzenesulfonic acid which is subsequently neutralized with KOH or NaOH.

EP-A-1 088 045 discloses that alkylphenol resins can be combined with amines. The examples concern salts of alkylphenol resins in which nearly half of the phenolic OH groups are neutralized.

EP-A-0 381 966 discloses a process for preparing novolaks by condensation of phenols with aldehydes under azeotropic removal of water. Suitable catalysts which are specified are strong mineral acids, especially sulfuric acid and acidic derivatives thereof. These may be neutralized before the workup of the reaction mixture, preferably with metal hydroxides or amines. In the examples, a sulfuric acid catalyst is used throughout and is subsequently neutralized with sodium hydroxide solution.

EP-A-0 311 452 discloses alkylphenol-formaldehyde condensates as cold additives for fuels and lubricant oils. The catalyst used is p-toluenesulfonic acid which remains as such in the resin.

Customary catalysts for the condensation reactions of alkylphenol and aldehyde are, in addition to carboxylic acids such as acetic acid and oxalic acid, especially strong mineral acids such as hydrochloric acid, phosphoric acid and sulfuric acid, and also sulfonic acids. Typically, they remain in the product as such or in neutralized form on completion of the reaction.

The prior art discloses the neutralization with a base of the catalyst used for the condensation of the alkylphenol resin. In practice, bases such as sodium hydroxide solution or potassium hydroxide solution are typically used for this purpose and lead to the formation of sodium or potassium salts of these strong acids. However, such salts are undesired for use as fuel additives, since they precipitate out of the oil in crystalline form and can cause line and filter blockages and lead to undesired residues (ash) in the course of combustion.

It is thus an object of the present invention to find an additive for improving both the conductivity and the cold properties of mineral oil distillates.

It has now been found that, surprisingly, the electrical conductivity of mineral oils which comprise alkylphenol resins can be distinctly improved by adding small amounts of oil-soluble ammonium salts of organic sulfonic acids. The effect achievable with ammonium salts is distinctly more marked than in the case of corresponding alkali metal salts. The thus additized oils exhibit a greatly increased conductivity and are thus substantially simpler to handle.

It has also been found that addition of small amounts of oil-soluble ammonium salts of organic sulfonic acids simultaneously enhances the activity of the alkylphenol-aldehyde resins as cold additives, especially as paraffin dispersants, and is additionally retained even after prolonged storage of the alkylphenol-aldehyde resin. This is thought to be based on a suppression of the decomposition of the alkylphenol resins to give intensely colored phenoxy and phenoxonium radicals.

The invention thus provides mineral oil distillates which have a sulfur content of 350 ppm or less and comprise from 5 to 500 ppm of at least one alkylphenol-aldehyde resin (constituent I) and from 0.001 to 10 ppm of at least one oil-soluble organic ammonium sulfonate (constituent II).

The invention further provides compositions comprising at least one alkylphenol-aldehyde resin and, based on the alkylphenol resin, from 0.005 to 10% by weight of at least one oil-soluble organic ammonium sulfonate.

The invention further provides for the use of compositions which comprise at least one alkylphenol-aldehyde resin and, based on this alkylphenol-aldehyde resin or these alkylphenol-aldehyde resins, contain from 0.005 to 10% by weight of at least one oil-soluble organic ammonium sulfonate to improve the electrical conductivity of low-sulfur middle distillates.

The invention further provides for the use of compositions which comprise at least one alkylphenol-aldehyde resin and, based on this alkylphenol-aldehyde resin or these alkylphenol-aldehyde resins, contain from 0.005 to 10% by weight of at least one oil-soluble organic ammonium sulfonate to improve the cold flowability of middle distillates.

The inventive ammonium sulfonates may be added as such to the mineral oil distillate or to the alkylphenol-aldehyde resin. They are preferably prepared by reacting the sulfonic acid used as a catalyst for the acidic condensation of the alkylphenol-aldehyde resin with the appropriate amines in the presence of the alkylphenol-aldehyde resins. Alternatively, they may be prepared by reacting an amine used as a catalyst for the basic condensation of the alkylphenol-aldehyde resin with corresponding sulfonic acids in the presence of the alkylphenol-aldehyde resins.

Sulfonic acids suitable for preparing the ammonium sulfonates are all oil-soluble compounds which contain at least one sulfonic acid group and at least one saturated or unsaturated, linear, branched and/or cyclic hydrocarbon radical having from 1 to 40 carbon atoms and preferably having from 3 to 24 carbon atoms. Particular preference is given to aromatic sulfonic acids, especially alkylaromatic monosulfonic acids having one or more $C_1$-$C_{28}$-alkyl radicals and especially those having $C_3$-$C_{22}$-alkyl radicals. The alkylaromatic sulfonic acids preferably bear one alkyl radical or two alkyl radicals, especially one alkyl radical. The parent aryl groups are preferably mono- and bicyclic, especially monocyclic. In a preferred embodiment, the aryl groups do not bear any carboxyl groups and they especially bear only sulfonic acid and alkyl groups. Suitable examples are methanesulfonic acid, butanesulfonic acid, benzenesulfonic acid, p-toluenesulfonic acid, xylenesulfonic acid, 2-mesitylenesulfonic acid, 4-ethylbenzenesulfonic acid, isopropylbenzenesulfonic acid, 4-butylbenzenesulfonic acid, 4-octylbenzenesulfonic acid; dodecylbenzenesulfonic acid, didodecylbenzenesulfonic acid, naphthalenesulfonic acid. Mixtures of these sulfonic acids are also suitable. Oil-soluble means here that the compounds mentioned are soluble at least to an extent of 1% by weight in aromatic solvents, for example toluene.

Suitable amines are oil-soluble basic nitrogen compounds of the general formula $$NR^1R^2R^3 \text{ and/or } NR^1R^2—[(CH_2)_n—NR^2]_mR^3$$

where $R^1$ is an alkyl radical having from 1 to 24 carbon atoms or an alkenyl radical having from 2 to 24 carbon atoms, $R^2$ and $R^3$ are each independently H or as defined for $R^1$, n is from 2 to 6, preferably 2 or 3, and m is from 1 to 6, preferably from 1 to 4. The alkyl and alkenyl radicals may each independently be linear, branched or cyclic. The amines thus include primary, secondary and tertiary amines whose alkyl radicals may be the same or different. The alkyl and alkenyl radicals may also bear functional groups, as long as they do not impair the oil solubility of the ammonium salts derived therefrom. The amines may bear one or else more nitrogen atoms, for example two, three, four or more nitrogen atoms. They are preferably mono- and diamines. They preferably bear two or three, especially three, alkyl radicals.

Suitable primary monoamines are, for example, methylamine, ethylamine, propylamine, butylamine, pentylamine, hexylamine, cyclohexylamine, octylamine, 2-ethylhexylamine, decylamine, dodecylamine, tetradecylamine, hexadecylamine, octadecylamine, ethanolamine and mixtures thereof, such as coconut fatty amine, tallow fatty amine.

Suitable secondary amines are, for example, dimethylamine, diethylamine, dipropylamine, dibutylamine, dipentylamine, dihexylamine, dioctylamine, di(2-ethylhexyl)amine, didodecylamine, ditetradecylamine, dihexadecylamine, dioctadecylamine, methylethylamine, diethanolamine and mixtures thereof such as dicoconut fatty amine, ditallow fatty amine.

Suitable tertiary monoamines are, for example, trimethylamine, triethylamine, tripropylamine, tributylamine, tripentylamine, trihexylamine, trioctylamine, tri(2-ethylhexyl) amine, tridodecylamine, tritetradecylamine and mixtures thereof, for example tricoconut fat amine, tritallow fat amine, N-methyl-N,N-dicoconut fat amine, N,N-dimethyl-N-stearylamine, N,N-dimethyl-N-coconut fat amine.

Suitable polyamines are, for example, N-alkylpropylenediamines and N,N-dialkyl-propylenediamines having $C_1$-$C_{24}$-alkyl radicals, such as N-coconut fat alkylpropylenediamine, N-tallow fat propylenediamine and dimethylaminopropylamine.

Suitable as amines are, for example, also compounds in which the nitrogen atom or atoms are part of a mono- or polycyclic aliphatic ring system having 4 to 40, preferably 5 to 20, more preferably 6 to 12 carbon atoms. The ring system may comprise 1, 2, 3, or 4 nitrogen atoms. The ring system may further comprise 1, 2 or 3 rings. Particularly preferred are monocyclic amines having one nitrogen atom and bicyclic amines having two nitrogen atoms. The nitrogen atom may also be a tertiary nitrogen atom bridging two rings. Suitable examples are pyrrolidine, piperidine, piperazine, diazabicycloundecene, diazabicyclononene, diazabicyclooctane, diazabicycloheptane and hexamethylene tetramine.

The inventive ammonium sulfonates are prepared by reacting the sulfonic acids with from 0.8 to 10 mol of amine, preferably from 0.9 to 5 mol of amine, more preferably from 0.95 to 2 mol of amine, for example in about equimolar amounts. In this context, especially in the case of polybasic sulfonic acids and/or amines, it is the total molar amount of acid and amino groups to be converted that is considered. The inventive additives and the middle distillates comprising them may accordingly, based on the sulfonic acid, also contain more than equimolar amounts of amines.

Alkylphenol-aldehyde resins are known in principle and are described, for example, in Römpp Chemie Lexikon, 9th edition, Thieme Verlag 1988-92, volume 4, p. 3351 ff. Suitable in accordance with the invention are in particular those alkylphenol-aldehyde resins which derive from alkylphenols having one or two alkyl radicals in the ortho- and/or para-position to the OH group. Particularly preferred starting materials are alkylphenols which bear, on the aromatic ring, at least two hydrogen atoms capable of condensation with aldehydes, and especially monoalkylated phenols whose alkyl radical is in the para-position. The alkyl radicals (for constituent 1, this refers generally to hydrocarbon radicals as defined above) may be the same or different in the alkylphenol-aldehyde resins usable in the process according to the invention, they may be saturated or unsaturated and have 1-200, preferably 1-20, in particular 4-12 carbon atoms; they are preferably n-, iso- and tert-butyl, n- and isopentyl, n- and isohexyl, n- and isooctyl, n- and isononyl, n- and isodecyl, n- and isododecyl, tetradecyl, hexadecyl, octadecyl, tripropenyl, tetrapropenyl, poly(propenyl) and poly(isobutenyl) radicals.

Suitable aldehydes for the alkylphenol-aldehyde resins are those having from 1 to 12 carbon atoms and preferably those having from 1 to 4 carbon atoms, for example formaldehyde, acetaldehyde, propionaldehyde, butyraldehyde, 2-ethylhexanal, benzaldehyde, glyoxalic acid and reactive equivalents thereof, such as paraformaldehyde and trioxane. Particular preference is given to formaldehyde in the form of paraformaldehyde and especially formalin.

The molecular weight of the alkylphenol-aldehyde resins is 400-20 000 g/mol, preferably 400-5000 g/mol. A prerequisite in this context is that the alkylphenol-aldehyde resins are oil-soluble at least in concentrations relevant to the application of from 0.001 to 1% by weight.

In a preferred embodiment of the invention, the alkylphenol-formaldehyde resins contain oligo- or polymers having a repeating structural unit of the formula

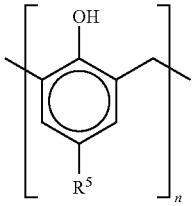

where $R^5$ is $C_1$-$C_{200}$-alkyl or -alkenyl and n is from 2 to 100. $R^5$ is preferably $C_4$-$C_{20}$-alkyl or -alkenyl and especially $C_6$-$C_{16}$-alkyl or -alkenyl. n is preferably from 2 to 50 and especially from 3 to 25, for example from 5 to 15.

For use in middle distillates such as diesel and heating oil, particular preference is given to alkylphenol-aldehyde resins having $C_2$-$C_{40}$-alkyl radicals of the alkylphenol, preferably having $C_4$-$C_{20}$-alkyl radicals, for example, $C_6$-$C_{12}$-alkyl radicals. The alkyl radicals may be linear or branched; they are preferably linear. Particularly suitable alkylphenol-aldehyde resins derive from linear alkyl radicals having 8 and 9 carbon atoms. The average molecular weight, determined by means of GPC, is preferably between 700 and 20 000, in particular between 800 and 10 000, for example between 1000 and 2500 g/mol.

For use in benzine and jet fuel, particular preference is given to alkylphenol-aldehyde resins whose alkyl radicals bear from 4 to 200 carbon atoms, preferably from 10 to 180 carbon atoms, and derive from oligomers or polymers of olefins having from 2 to 6 carbon atoms, for example from poly(isobutylene). They are thus preferably branched. The degree of polymerization (n) here is preferably between 2 and 20 alkylphenol units, preferably between 3 and 10 alkylphenol units.

These alkylphenol-aldehyde resins are obtainable by known processes, for example by condensation of the appropriate alkylphenols with formaldehyde, i.e. with from 0.5 to 1.5 mol, preferably from 0.8 to 1.2 mol, of formaldehyde per mole of alkylphenol. The condensation may be effected without solvent, but is preferably effected in the presence of a water-immiscible or only partly water-miscible inert organic solvent such as mineral oils, alcohols, ethers and the like. Particular preference is given to solvents which can form azeotropes with water. Useful such solvents are in particular aromatics such as toluene, xylene, diethylbenzene and relatively high-boiling commercial solvent mixtures such as ®Shellsol AB and Solvent Naphtha. The condensation is effected preferably between 70 and 200° C., for example between 90 and 160° C. It is catalyzed typically by from 0.05 to 5% by weight of bases or acids. For example, the condensation catalyzed by amines, preferably tertiary amines, for example triethylamine, with subsequent neutralization by means of organic sulfonic acid leads to the inventive mixtures. Preference is given in accordance with the invention to catalysis by organic sulfonic acids which, on completion of the condensation with amines, are converted to the inventive oil-soluble ammonium sulfonates.

The inventive additives increase the conductivity of mineral oils such as benzine, kerosine, jet fuel, diesel and heating oil, having a low sulfur content of less than 500 ppm, in particular less than 50 ppm, for example less than 10 or less than 5 ppm. At the same time, they improve the cold properties, especially of middle distillates such as kerosene, jet fuel, diesel and heating oil.

To improve the cold flowability, the inventive additives may also be added to middle distillates in combination with further additives, for example ethylene copolymers, polar nitrogen compounds, comb polymers, polyoxyalkylene compounds and/or olefin copolymers.

The present invention thus provides a novel additive package which simultaneously improves the cold properties and the antistatic properties of low-sulfur mineral oils.

In a preferred embodiment, the inventive additives for middle distillates thus comprise, in addition to the constituents I and II, also one or more of the components III to VII. Thus, they preferably comprise copolymers composed of ethylene and olefinically unsaturated compounds as constituent III. Suitable ethylene copolymers are in particular those which contain, in addition to ethylene, from 6 to 21 mol %, in particular from 10 to 18 mol %, of comonomers. These copolymers preferably have melt viscosities at 140° C. of from 20 to 10 000 mPas, in particular of from 30 to 5000 mPas, especially of from 50 to 2000 mPas.

The olefinically unsaturated compounds are preferably vinyl esters, acrylic esters, methacrylic esters, alkyl vinyl ethers and/or alkenes, and the compounds mentioned may be substituted by hydroxyl groups. One or more comonomers may be present in the polymer.

The vinyl esters are preferably those of the formula 1

$$CH_2{=}CH{-}OCOR^1 \quad (1)$$

where $R^1$ is $C_1$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^1$ is a branched alkyl radical or a neoalkyl radical having from 7 to 11 carbon atoms, in particular having 8, 9 or 10 carbon atoms. Particularly preferred vinyl esters derive from secondary and especially tertiary carboxylic acids whose branch is in the alpha-position to the carbonyl group. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and Versatic esters such as vinyl neononanoate, vinyl neodecanoate, vinyl neoundecanoate.

In a preferred embodiment, these ethylene copolymers contain vinyl acetate and at least one further vinyl ester of the formula 1 where $R^1$ is $C_4$- to $C_{30}$-alkyl, preferably $C_4$- to $C_{16}$-alkyl, especially $C_6$- to $C_{12}$-alkyl.

The acrylic esters are preferably those of the formula 2

$$CH_2{=}CR^2{-}COOR^3 \quad (2)$$

where $R^2$ is hydrogen or methyl and $R^3$ is $C_1$- to $C_{30}$-alkyl, preferably $C_4$- to $C_{16}$-alkyl, especially $C_6$- to $C_{12}$-alkyl. Suitable acrylic esters include, for example, methyl (meth)acrylate, ethyl (meth)acrylate, propyl (meth)acrylate, n- and isobutyl (meth)acrylate, hexyl, octyl, 2-ethylhexyl, decyl, dodecyl, tetradecyl, hexadecyl, octadecyl (meth)acrylate and mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 3

$$CH_2{=}CH{-}OR^4 \quad (3)$$

where $R^4$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having from 3 to 30 carbon atoms, in particular from 4 to 16 carbon atoms and especially from 5 to 12 carbon atoms. Suitable alkenes include propene, butene, isobutylene, pentene, hexene, 4-methylpentene, octene, diisobutylene and norbornene and derivatives thereof such as methylnorbornene and vinylnorbornene. In a further embodiment, the alkyl groups mentioned may be substituted by one or more hydroxyl groups.

Apart from ethylene, particularly preferred terpolymers contain from 0.1 to 12 mol %, in particular from 0.2 to 5 mol %, of vinyl neononanoate or of vinyl neodecanoate, and from 3.5 to 20 mol %, in particular from 8 to 15 mol %, of vinyl acetate, the total comonomer content being between 8 and 21 mol %, preferably between 12 and 18 mol %. Further particularly preferred copolymers contain, in addition to ethylene and from 8 to 18 mol % of vinyl esters, also from 0.5 to 10 mol % of olefins such as propene, butene, isobutylene, hexene, 4-methylpentene, octene, diisobutylene and/or norbornene.

Preference is given to using mixtures of two or more of the abovementioned ethylene copolymers. More preferably, the polymers on which the mixtures are based differ in at least one characteristic. For example, they may contain different comonomers, different comonomer contents, molecular weights and/or degrees of branching.

The mixing ratio between the inventive additives and ethylene copolymers as constituent III may, depending on the application, vary within wide limits, the ethylene copolymers III often constituting the major proportion. Such additive mixtures preferably contain from 2 to 70% by weight, preferably from 5 to 50% by weight, of the inventive additive combination of I and II, and also from 30 to 98% by weight, preferably from 50 to 95% by weight, of ethylene copolymers.

The oil-soluble polar nitrogen compounds suitable in accordance with the invention as a further component (constituent IV) are preferably reaction products of fatty amines with compounds which contain an acyl group. The preferred amines are compounds of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $-(A\text{-}O)_x\text{-}E$ or $—(CH_2)_n—NYZ$, where A is an ethyl or propyl group, x is a number from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and in particular between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, in particular of dicoconut fatty amine, ditallow fatty amine and distearylamine.

Acyl group refers here to a functional group of the following formula:

$$C{=}O$$

Carbonyl compounds suitable for the reaction with amines are either low molecular weight or polymeric compounds having one or more carboxyl groups. Preference is given to those low molecular weight carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be in particular copolymers of ethylenically unsaturated acids, for example acrylic acid, methacrylic acid, maleic acid, fumaric acid and itaconic acid; particular preference is given to copolymers of maleic anhydride. Suitable comonomers are those which confer oil solubility on the copolymer. Oil-soluble means here that the copolymer, after reaction with the fatty amine, dissolves without residue in the middle distillate to be additized in practically relevant dosages. Suitable comonomers are, for example, olefins, alkyl esters of acrylic acid and methacrylic acid, alkyl vinyl esters, alkyl vinyl ethers having from 2 to 75, preferably from 4 to 40 and in particular from 8 to 20, carbon atoms in the alkyl radical. In the case of olefins, the alkyl radical attached to the double bond is equivalent here. The molecular weights of the polymeric carbonyl compounds are preferably between 400 and 20 000, more preferably between 500 and 10 000, for example between 1000 and 5000.

It has been found that oil-soluble polar nitrogen compounds which are obtained by reaction of aliphatic or aromatic amines, preferably long-chain aliphatic amines, with aliphatic or aromatic mono-, di-, tri- or tetracarboxylic acids or their anhydrides are particularly useful (cf. U.S. Pat. No. 4,211,534). Equally suitable as oil-soluble polar nitrogen compounds are amides and ammonium salts of aminoalkylenepolycarboxylic acids such as nitrilotriacetic acid or ethylenediaminetetraacetic acid with secondary amines (cf. EP 0 398 101). Other oil-soluble polar nitrogen compounds are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α,β-unsaturated compounds and polyoxyalkylene ethers of lower unsaturated alcohols.

The mixing ratio between the inventive additives and oil-soluble polar nitrogen compounds as constituent IV may vary depending upon the application. Such additive mixtures preferably contain from 10 to 90% by weight, preferably from 20 to 80% by weight, of the inventive additive combination of I and II, and from 10 to 90% by weight, preferably from 20 to 80% by weight, of oil-soluble polar nitrogen compounds.

Comb polymers suitable as a further component (constituent V) may be described, for example, by the formula

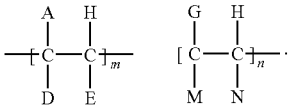

In this formula

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

Polyoxyalkylene compounds suitable as a further component (constituent VI) are, for example, esters, ethers and ether/esters which bear at least one alkyl radical having from 12 to 30 carbon atoms. When the alkyl groups stem from an acid, the remainder stems from a polyhydric alcohol; when the alkyl radicals come from a fatty alcohol, the remainer of the compound stems from a polyacid.

Suitable polyols are polyethylene glycols, polypropylene glycols, polybutylene glycols and copolymers thereof having a molecular weight of from approx. 100 to approx. 5000, preferably from 200 to 2000. Also suitable are alkoxylates of polyols, for example of glycerol, trimethylolpropane, pentaerythritol, neopentyl glycol, and the oligomers which are obtainable therefrom by condensation and have from 2 to 10 monomer units, for example polyglycerol. Preferred alkoxylates are those having from 1 to 100 mol, in particular from 5 to 50 mol, of ethylene oxide, propylene oxide and/or butylene oxide per mole of polyol. Esters are particularly preferred.

Fatty acids having from 12 to 26 carbon atoms are preferred for the reaction with the polyols to form the ester additives, and particular preference is given to using $C_{18}$- to $C_{24}$-fatty acids, especially stearic and behenic acid. The esters may also be prepared by esterifying polyoxyalkylated alcohols. Preference is given to fully esterified polyoxyalkylated polyols having molecular weights of from 150 to 2000, preferably from 200 to 600. Particularly suitable are PEG-600 dibehenate and glycerol ethylene glycol tribehenate.

Suitable olefin copolymers (constituent VII) as a further constituent of the inventive additive may derive directly from monoethylenically unsaturated monomers, or indirectly by hydrogenation of polymers which derive from polyunsaturated monomers such as isoprene or butadiene. Preferred copolymers contain, in addition to ethylene, structural units which derive from α-olefins having from 3 to 24 carbon atoms and molecular weights of up to 120 000 g/mol. Preferred α-olefins are propylene, butene, isobutene, n-hexene, isohexene, n-octene, isooctene, n-decene, isodecene. The comonomer content of olefins is preferably between 15 and 50 mol %, more preferably between 20 and 35 mol % and especially between 30 and 45 mol %. These copolymers may also contain small amounts, for example up 10 mol %, of further comonomers, for example nonterminal olefins or nonconjugated olefins. Preference is given to ethylene-propylene copolymers. The olefin copolymers may be prepared by known methods, for example by means of Ziegler or metallocene catalysts.

Further suitable olefin copolymers are block copolymers which contain blocks composed of olefinically unsaturated aromatic monomers A and blocks composed of hydrogenated polyolefins B. Particularly suitable block copolymers have the structure (AB)nA and (AB)m, where n is between 1 and 10 and m is between 2 and 10.

The additives may be used alone or else together with other additives, for example with other pour point depressants or dewaxing assistants, with antioxidants, cetane number improvers, dehazers, demulsifiers, detergents, dispersants, antifoams, dyes, corrosion inhibitors, lubricity additives, foam inhibitors, odorants and/or additives for lowering the cloud point.

The mixing ratio between the inventive additive combinations of I and II and the further constituents V, VI and VII is generally in each case between 1:10 and 10:1, preferably between 1:5 and 5:1.

The inventive additives are suitable for improving the electrostatic properties and the cold flow properties of animal, vegetable or mineral oils. In particular, they increase the electrical conductivity of the additized oils and thus enable safe handling, for example in the course of pumped circulation and shipping. They are particularly suitable for the improvement of the electrostatic properties of mineral oils such as jet fuel, benzine, kerosene, diesel and heating oil, which had been subjected to refining under hydrogenating conditions for the purpose of lowering the sulfur content. These oils contain preferably less than 350 ppm of sulfur and in particular less than 100 ppm of sulfur, for example less than 50 ppm or 10 ppm of sulfur.

In addition, they disperse the paraffins which precipitate out below the cloud point in middle distillates. In particular, they are superior to the prior art additives in problematic oils having a low aromatics content of less than 25% by weight, in particular less than 22% by weight, for example less than 20% by weight, of aromatics, and thus lower solubility for n-paraffins. Middle distillates refer in particular to those mineral oils which are obtained by distillation of crude oil and boil in the range from 120 to 450° C., for example kerosene, jet fuel, diesel and heating oil. Aromatic compounds refer to the totality of mono-, di- and polycyclic aromatic compounds, as can be determined by means of HPLC to DIN EN 12916 (2001 edition). The inventive additives are particularly advantageous in those middle distillates which contain less than 350 ppm of sulfur, more preferably less than 100 ppm of sulfur, in particular less than 50 ppm of sulfur and in special cases less than 10 ppm of sulfur. They are generally those middle distillates which have been subjected to refining under hydrogenating conditions and therefore contain only small fractions of polyaromatic and polar compounds. They are preferably those middle distillates which have 90% distillation points below 360° C., in particular 350° C. and in special cases below 340° C.

EXAMPLES

TABLE 1

The test oils used were current from European refineries. The CFPP value was determined to EN 116 and the cloud point to ISO 3015. The aromatic hydrocarbon groups were determined to DIN EN 12916 (November 2001 edition).

| | | Test oil 1 | Test oil 2 | Test oil 3 | Test oil 4 |
|---|---|---|---|---|---|
| Distillation | | | | | |
| IBP | [° C.] | 161 | 191 | 193 | 173 |
| 20% | [° C.] | 193 | 241 | 229 | 208 |
| 90% | [° C.] | 226 | 330 | 329 | 334 |
| FBP | [° C.] | 247 | 352 | 351 | 359 |
| Cloud point | [° C.] | −38 | −5.9 | −5.7 | −7.2 |
| CFPP | [° C.] | <−40 | −8 | −9 | −9 |
| Sulfur | [ppm] | 6 | 172 | 19 | 8 |
| Density @15° C. | [g/cm$^3$] | 0.8034 | 0.8335 | 0.8313 | 0.8261 |
| Aromatics content | [% by wt.] | 18.24 | 21.77 | 18.22 | 18.52 |
| of which mono | [% by wt.] | 18.01 | 18.69 | 16.95 | 17.33 |
| di | [% by wt.] | 0.23 | 2.88 | 1.19 | 1.06 |
| poly | [% by wt.] | — | 0.21 | 0.08 | 0.13 |

The following additives were used:

(A) Mixtures of Alkylphenol Resins and Sulfonic Acid Salts

A1) acid-catalyzed nonylphenol-formaldehyde resin (Mw 1300 g/mol) with 2.4% by weight of triethanolammonium dodecylbenzenesulfonate A2) acid-catalyzed nonylphenol-formaldehyde resin (Mw 1300 g/mol) with 3.5% by weight of di(cocoalkyl)ammonium dodecylbenzenesulfonate, A3) acid-catalyzed nonylphenol-formaldehyde resin (Mw) 1300 g/mol with 2.1% by weight of cyclohexylammonium dodecylbenzenesulfonate, A4) acid-catalyzed nonylphenol-formaldehyde resin (Mw 1400 g/mol) with 0.3% by weight of diethanolammonium dodecylbenzenesulfonate, A5) acid-catalyzed nonylphenol-formaldehyde resin (Mw 1300 g/mol) with 2.1% by weight of triethylammonium dodecylbenzenesulfonate, A6) acid-catalyzed nonylphenol-formaldehyde resin (Mw 1300 g/mol) with 2.5% by weight of tributylammonium dodecylbenzenesulfonate, A7) acid-catalyzed nonylphenol-formaldehyde resin (Mw 1300 g/mol) with 2.9% by weight of N-cocoalkylpropylenediamineammonium dodecylbenzenesulfonate A8) alkali-catalyzed dodecylphenol-formaldehyde resin (Mw 1450 g/mol) with 2.1% by weight of tributylammonium 4-butylbenzenesulfonate A9) acid-condensed butylphenol-formaldehyde resin (Mw 1200 g/mol)

with 2.5% by weight of di(cocoalkyl)ammonium p-toluenesulfonate

A10) acid-catalyzed nonylphenol-formaldehyde resin (Mw 1300 g/mol); (comparison)

A11) acid-catalyzed nonylphenol-formaldehyde resin (Mw 1300 g/mol) with 1.6% by weight of sodium dodecylbenzenesulfonate (comparison)

The mixtures A1) to A10) were used as 50% dilutions in Solvent Naphtha, a commercial mixture of high-boiling aromatic hydrocarbons.

Improvement of the electrical conductivity of middle distillates

For conductivity measurements, the additives were dissolved under agitation with the concentration specified in each case in 2 l of the test oil 1. An automatic conductivity meter was used to determine the electrical conductivity therein. The unit of electrical conductivity is the picosiemen/m (pS/m). For jet fuel, a conductivity of at least 50 pS/m is generally specified.

TABLE 2

Electrical conductivity of test oil 1 with addition of ammonium sulfonates

| Example | Additive | 0 ppm | 1 ppm | 2 ppm | 3 ppm |
|---|---|---|---|---|---|
| 1 (comp.) | triethanolammonium didodecylbenzenesulfonate | 9 | 12 | 14 | 18 |
| 2 (comp.) | N-triethylammonium didodecylbenzenesulfonate | 9 | 13 | 18 | 22 |
| 3 (comp.) | N-cocoalkylpropylenediamineammonium didodecylbenzenesulfonate | 9 | 12 | 16 | 20 |
| 4 (comp.) | tributylammonium 4-butylbenzenesulfonate | 9 | 10 | 12 | 16 |
| 5 (comp.) | sodium dodecylbenzenesulfonate | 9 | 10 | 10 | 12 |

For the sake of better comparability, the ammonium sulfonates were likewise used as 50% dilutions in Solvent Naphtha.

TABLE 3

Electrical conducitivity with addition of inventive additives

| Example | Additive | 0 ppm | 50 ppm | 100 ppm | 150 ppm |
|---|---|---|---|---|---|
| 6 | A1 | 9 | 56 | 98 | 140 |
| 7 | A5 | 9 | 52 | 95 | 133 |
| 8 | A7 | 9 | 61 | 110 | 161 |
| 9 | A8 | 9 | 49 | 89 | 127 |
| 10 (comp.) | A10 | 9 | 20 | 31 | 42 |
| 11 (comp.) | A11 | 9 | 23 | 38 | 51 |

Effectiveness of the Additives as Cold Flow Improvers

To assess the effect of the inventive additives on the cold flow properties of middle distillates, the inventive additives (A) were used with different coadditives. The ethylene copolymers (B) and paraffin dispersants (C) used are commercial products having characteristics specified below. The products were used as 50% dilutions in kerosene or Solvent Naphtha.

The superior effectiveness of the inventive additives together with ethylene copolymers and paraffin dispersants for mineral oils and mineral oil distillates is described firstly with reference to the CFPP test (Cold Filter Plugging Test to EN 116).

In addition, the paraffin dispersancy in middle distillates is determined in the short sedimentation test as follows:

150 ml of the middle distillates admixed with the additive components specified in the table were cooled in 200 ml measuring cylinders to −13° C. at −2° C./hour in a cold cabinet, and stored at this temperature for 16 hours. Subsequently, volume and appearance both of the sedimented paraffin phase and of the supernatant oil phase were determined and assessed visually. A small amount of sediment and a turbid oil phase show good paraffin dispersancy.

In addition, the lower 20% by volume are isolated and the cloud point is determined to IP 3015. Only a small deviation of the cloud point of the lower phase (CPCC) from the blank value of the oil shows good paraffin dispersancy.

(B) Characterization of the Ethylene Copolymers Used

B1 Copolymer of ethylene and 13.6 mol % of vinyl acetate having a melt viscosity, measured at 140° C., of 120 mPas; 65% in kerosene B2 Terpolymer of ethylene, 13.7 mol % of vinyl acetate and 1.4 mol % of vinyl neodecanoate having a melt viscosity, measured at 140° C., of 98 mPas, 65% in kerosene.

B3 Mixture of two parts of B1 and one part of B2, 65% in kerosene (C) Characterization of the Paraffin Dispersants C Used C1 Reaction product of a dodecenyl-spiro-bislactone with a mixture of primary and secondary tallow fatty amine, 60% in Solvent Naphtha (prepared according to EP 0413279)

C2 Reaction product of a terpolymer of $C_{14/16}$-α-olefin, maleic anhydride and allylpolyglycol with 2 equivalents of ditallow fatty amine, 50% in Solvent Naphtha (prepared according to EP 0606055)

C3 Reaction product of phthalic anhydride and 2 equivalents of di(hydrogenated tallow fat) amine, 50% in Solvent Naphtha (prepared according to EP 0 061 894)

C4 Reaction product of ethylenediaminetetraacetic acid with 4 equivalents of ditallow fatty amine to the amide-ammonium salt (prepared according to EP 0 398 101).

TABLE 4

Testing as a cold flow improver in test oil 2

| | Additives | | | Test oil 2 (CP −5.9° C.) | | |
|---|---|---|---|---|---|---|
| Example | A | B | C | Sediment [% by vol.] | Oil phase appearance | CPCC [° C.] |
| 12 (comp.) | 50 ppm A10 | 200 ppm B1 | 100 ppm C2 | 5 | clear | 4.2 |
| 13 (comp.) | 50 ppm A10 | 400 ppm B1 | 100 ppm C2 | 1 | turbid | −3.2 |
| 14 | 50 ppm A1 | 200 ppm B1 | 100 ppm C2 | 4 | cloudy | 3.0 |
| 15 | 50 ppm A1 | 400 ppm B1 | 100 ppm C2 | 0 | turbid | −4.7 |
| 16 | 50 ppm A2 | 400 ppm B1 | 100 ppm C2 | 0 | turbid | −5.0 |
| 17 | 50 ppm A5 | 400 ppm B1 | 100 ppm C2 | 0 | turbid | −4.1 |
| 18 | 50 ppm A6 | 400 ppm B1 | 100 ppm C2 | 0 | turbid | −4.9 |
| 19 | 50 ppm A7 | 400 ppm B1 | 100 ppm C2 | 0 | turbid | −5.2 |
| 20 | 50 ppm A1 | 200 ppm B2 | 100 ppm C3 | 0 | turbid | −4.3 |
| 21 | 50 ppm A1 | 200 ppm B2 | 100 ppm C4 | 0 | turbid | −4.5 |

TABLE 5

Testing as cold flow improvers in test oil 3

| | Additives | | | Test oil 3 (CP −5.7° C.) | | |
|---|---|---|---|---|---|---|
| Example | A | B | C | Sediment [% by vol.] | Oil phase appearance | $CP_{CC}$ [° C.] |
| 22 (comp.) | 50 ppm A10 | 200 ppm B1 | 100 ppm C2 | 5 | clear | 4.2 |
| 23 (comp.) | 50 ppm A10 | 400 ppm B1 | 100 ppm C2 | 1 | turbid | −3.2 |
| 24 | 50 ppm A1 | 200 ppm B1 | 100 ppm C2 | 4 | cloudy | 3.0 |
| 25 | 50 ppm A1 | 400 ppm B1 | 100 ppm C2 | 0 | turbid | −4.7 |
| 26 | 50 ppm A2 | 400 ppm B1 | 100 ppm C2 | 0 | turbid | −5.0 |
| 27 | 50 ppm A5 | 400 ppm B1 | 100 ppm C2 | 0 | turbid | −4.1 |
| 28 | 50 ppm A6 | 400 ppm B1 | 100 ppm C2 | 0 | turbid | −4.9 |
| 29 | 50 ppm A7 | 400 ppm B1 | 100 ppm C2 | 0 | turbid | −5.2 |
| 30 | 50 ppm A1 | 200 ppm B2 | 100 ppm C3 | 0 | turbid | −4.3 |
| 31 | 50 ppm A1 | 200 ppm B2 | 100 ppm C4 | 0 | turbid | −4.5 |

TABLE 6

Testing as cold flow improvers in test oil 4
The CFPP value and paraffin dispersancy were determined in the short sedimentation test after additization of the test oil with 200 ppm of flow improver B3 and 100 ppm of paraffin dispersant C2.

| Example | Additive A | CFPP [° C.] | Sediment [% by vol.] | Oil phase appearance | CPCC [° C.] |
|---|---|---|---|---|---|
| 32 (comp.) | 50 ppm A10 | −24 | 0 | turbid | −2.0 |
| 33 | 50 ppm A1 | −28 | 0 | turbid | −4.4 |
| 34 | 50 ppm A2 | −25 | 0 | turbid | −3.2 |
| 35 | 50 ppm A3 | −30 | 0 | turbid | −3.0 |
| 36 | 50 ppm A4 | −26 | 0 | turbid | −2.9 |
| 37 | 50 ppm A5 | −31 | 0 | turbid | −3.4 |
| 38 | 50 ppm A6 | −24 | 0 | turbid | −3.9 |
| 39 | 50 ppm A7 | −30 | 0 | turbid | −4.4 |
| 40 | 50 ppm A8 | −29 | 0 | turbid | −4.8 |

Long-Term Stability of the Additives

The long-term stability of the inventive additives was tested using additive (A1) directly after preparation for its performance in the short sedimentation test and compared with the action of the same composition after storage at 50° C. for five weeks. For comparison, an alkylphenol-aldehyde resin without additive (A0) was tested under the same conditions. In contrast to the inventive additive, this had become distinctly darker after the storage.

The short sedimentation test was carried out in test oil 4 which contained 200 ppm of B3 and 100 ppm of C1, with in each case 50 ppm of the resin A10 or A1.

TABLE 7

Short sedimentation test in test oil 4

| Example | Additive A | Test oil 4 (CP −7.2° C.) CFPP [° C.] | Sediment [% by vol.] | Oil phase appearance | $CP_{cc}$ [° C.] |
|---|---|---|---|---|---|
| 41 (comp.) | 50 ppm A10 (immediately) | −24 | 0 | turbid | −2.0 |
| 42 (comp.) | 50 ppm A10 (after 5 weeks) | −22 | 2 | turbid | 0.2 |
| 43 | 50 ppm A1 (immediately) | −28 | 0 | turbid | −4.4 |
| 44 | 50 ppm A1 (after 5 weeks) | −27 | 0 | turbid | −4.5 |
| 45 | 50 ppm A5 (immediately) | −26 | 0 | turbid | −4.8 |
| 46 | 50 ppm A5 (after 5 weeks) | −26 | 0 | turbid | −4.6 |

The experiments show that the inventive additives are superior to the prior art additives with regard to the improvement in the cold flowability and especially the paraffin dispersancy of middle distillates. In addition, they show that the inventive mixtures simultaneously have a marked synergistic effect with regard to the improvement of the electrical conductivity of middle distillates. In contrast, neither sulfonate salts alone nor alkylphenol resins alone have a significant influence on the conductivity of low-sulfur middle distillates. The inventive mixtures thus allow the conductivity of oils additized with alkylphenol resins to be improved to more than 50 pS/m with only small amounts of ammonium sulfonate, and thus ensure risk-free handling of the additized oils.

What is claimed is:

1. A mineral oil distillate having a sulfur content of 350 ppm or less, which comprises from 5 to 500 ppm of at least one alkylphenol-aldehyde resin (constituent I) and from 0.001 to 10 ppm of at least one oil-soluble organic ammonium sulfonate (constituent II), wherein the one alkylphenol-aldehyde resin has a repeating structural unit of the formula

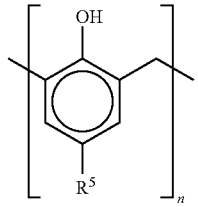

where $R^5$ is $C_1$-$C_{200}$-alkyl or -alkenyl and n is from 2 to 100.

2. The mineral oil distillate of claim 1, wherein the aldehyde which is condensed to form the at least one alkylphenol-aldehyde resin has from 1 to 12 carbon atoms.

3. The mineral oil distillate of claim 1, wherein the at least one alkylphenol-aldehyde resin has an alkyl group with from 1 to 200 carbon atoms.

4. The mineral oil distillate of claim 1, wherein the at least one alkylphenol-aldehyde resin has a molecular weight of from 400 to 20 000 g/mol.

5. The mineral oil distillate of claim 1, wherein the at least one oil-soluble organic ammonium sulfonate is prepared from an oil soluble sulfonic acid having at least one sulfonic acid group and at least one saturated or unsaturated radical selected from the group consisting of a linear, a branched, a cyclic hydrocarbon radical, and mixtures thereof having from 1 to 40 carbon atoms.

6. The mineral oil distillate of claim 1, wherein the at least one oil-soluble organic ammonium sulfonate is prepared from an oil-soluble amine of the general formulae $$NR^1R^2R^3 \text{ or } NR^1R^2—[(CH_2)_n—NR^2]_mR^3$$

or mixtures thereof, where $R^1$ is an alkyl radical having from 1 to 24 carbon atoms or an alkenyl radical having from 2 to 24 carbon atoms, $R^2$ and $R^3$ are each independently H or as defined for $R^1$, n is from 2 to 6 and m is from 1 to 6.

7. The mineral oil distillate of claim 1, further comprising a copolymer comprising as monomers ethylene and from 6 to 21 mol % of a compound selected from the group consisting of a vinyl ester, an acrylic ester, a methacrylic ester, an alkyl vinyl ester, and mixtures thereof, and optionally an alkene.

8. The mineral oil distillate of claim 1, further comprising a reaction product of a compound of the formula $NR^6R^7R^8$, where $R^6$, $R^7$ and $R^8$ may be the same or different and at least one of these groups is $C_8$-$C_{36}$-alkyl, $C_6$-$C_{36}$-cycloalkyl, $C_8$-$C_{36}$-alkenyl, and the remaining groups are either hydrogen, $C_1$-$C_{36}$-alkyl, $C_2$-$C_{36}$-alkenyl, cyclohexyl, or a group of the formulae -(A-O)$_x$-E or —(CH$_2$)$_n$—NYZ, where A is an ethyl or propyl group, x is from 1 to 50, E=H, C$_1$-C$_{30}$-alkyl, C$_5$-C$_{12}$-cycloalkyl or C$_6$-C$_{30}$-aryl, and n=2, 3 or 4, and Y and Z are each independently H, C$_1$-C$_{30}$-alkyl or (A-O)$_x$ with compounds which have a functional group of the formula

>C=O.

9. The mineral oil distillate of claim 1, wherein said distillate further comprises a comb polymer of the formula

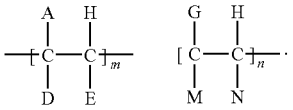

where

A is R', COOR', OCOR', R"-COOR', OR';

D is H, CH$_3$, A or R";

E is H, A;

G is H, R", R"-COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

10. The mineral oil distillate of claim 1, wherein said distillate further comprises a polyoxyalkylene compound selected from the group consisting of an ester, an ether, an ester/ether, and mixtures thereof, said compound having at least one alkyl radical having from 12 to 30 carbon atoms.

11. The mineral oil distillate of claim 1, wherein said distillate further comprises a copolymer comprising structural units of ethylene, structural units which derive from α-olefins having from 3 to 24 carbon atoms and having a molecular weight of up to 120 000 g/mol.

12. A method for improving the electrical conductivity of low sulfur middle distillates, said method comprising adding to said middle distillates having a sulfur content of 350 ppm or less a composition comprising at least one alkylphenol-aldehyde resin and from 0.005 to 10% by weight of at least one oil-soluble organic ammonium sulfonate, based on the alkylphenol-aldehyde resin, wherein the at least one alkylphenol-aldehyde resin has a repeating structural unit of the formula

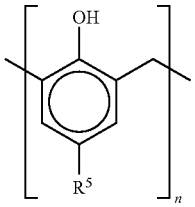

where R$^5$ is C$_1$-C$_{200}$-alkyl or -alkenyl and n is from 2 to 100.

13. The method of claim 12, wherein the aldehyde which is condensed to form the at least one alkylphenol-aldehyde resin has from 1 to 12 carbon atoms.

14. The method of claim 12, wherein the at least one alkylphenol-aldehyde resin has an alkyl group with from 1 to 200 carbon atoms.

15. The method of claim 12, wherein the at least one alkylphenol-aldehyde resin has a molecular weight of from 400 to 20 000 g/mol.

16. The method of claim 12, wherein the at least one oil-soluble organic ammonium sulfonate is prepared from an oil soluble sulfonic acid having at least one sulfonic acid group and at least one saturated or unsaturated radical selected from the group consisting of a linear, a branched, a cyclic hydrocarbon radical, and mixtures thereof having from 1 to 40 carbon atoms.

17. The method of claim 12, wherein the at least one oil-soluble organic ammonium sulfonate is prepared from an oil-soluble amine of the general formulae $$NR^1R^2R^3 \text{ or } NR^1R^2—[(CH2)_n\text{-}NR^2]_mR^3$$

or mixtures thereof, where R$^1$ is an alkyl radical having from 1 to 24 carbon atoms or an alkenyl radical having from 2 to 24 carbon atoms, R$^2$ and R$^3$ are each independently H or as defined for R$^1$, n is from 2 to 6 and m is from 1 to 6.

18. The method of claim 12, wherein the composition further comprises a copolymer comprising as monomers ethylene and from 6 to 21 mol % of a compound selected from the group consisting of a vinyl ester, an acrylic ester, a methacrylic ester, an alkyl vinyl ester, and mixtures thereof, and optionally an alkene.

19. The method of claim 12, wherein the composition further comprises a reaction product of a compound of the formula NR$^6$R$^7$R$^8$, where R$^6$, R$^7$ and R$^8$ may be the same or different and at least one of these groups is C$_8$-C$_{36}$-alkyl, C$_6$-C$_{36}$-cycloalkyl, C$_8$-C$_{36}$-alkenyl, and the remaining groups are either hydrogen, C$_1$-C$_{36}$-alkyl, C$_2$-C$_{36}$-alkenyl, cyclohexyl, or a group of the formulae -(A-O)$_x$-E or —(CH$_2$)$_n$—NYZ, where A is an ethyl or propyl group, x is from 1 to 50, E=H, C$_1$-C$_{30}$-alkyl, C$_5$-C$_{12}$-cycloalkyl or C$_6$-C$_{30}$-aryl, and n=2, 3 or 4, and Y and Z are each independently H, C$_1$-C$_{30}$-alkyl or -(A-O)$_x$ with compounds which have a functional group of the formula

>C=O.

20. The method of claim 12, wherein the composition further comprises a comb polymer of the formula

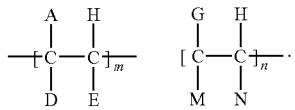

where

A is R', COOR', OCOR', R"-COOR', OR∝0;

D is H, CH$_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

21. The method of claim 12, wherein the composition further comprises a polyoxyalkylene compound selected from the group consisting of an ester, an ether, an ester/ether, and mixtures thereof, said compound having at least one alkyl radical having from 12 to 30 carbon atoms.

22. The method of claim 12, wherein the composition further comprises a copolymer comprising structural units of ethylene, structural units which derive from α-olefins having from 3 to 24 carbon atoms and having a molecular weight of up to 120 000 g/mol.

23. A method for improving the cold flowability of low sulfur middle distillates, said method comprising adding to said middle distillates having a sulfur content of 350 ppm or less a composition comprising at least one alkylphenol-aldehyde resin and, based on the alkylphenol-aldehyde resin from 0.005 to 10% by weight of at least one oil-soluble organic ammonium sulfonate wherein the at least one alkylphenol-aldehyde resin has a repeating structural unit of the formula

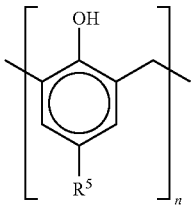

where $R^5$ is $C_1$-$C_{200}$-alkyl or -alkenyl and n is from 2 to 100.

24. The method of claim 23, wherein the at least one alkylphenol-aldehyde resin has a molecular weight of from 400 to 20 000 g/mol.

25. The method of claim 23, wherein the at least one oil-soluble organic ammonium sulfonate is prepared from an oil soluble sulfonic acid having at least one sulfonic acid group and at least one saturated or unsaturated radical selected from the group consisting of a linear, a branched, a cyclic hydrocarbon radical, and mixtures thereof having from 1 to 40 carbon atoms.

26. The method of claim 23, wherein the at least one oil-soluble organic ammonium sulfonate is prepared from an oil-soluble amine of the general formulae $$NR^1R^2R^3 \text{ or } NR^1R^2—[(CH2)_n\text{-}NR^2]_mR^3$$

or mixtures thereof, where $R^1$ is an alkyl radical having from 1 to 24 carbon atoms or an alkenyl radical having from 2 to 24 carbon atoms, $R^2$ and $R^3$ are each independently H or as defined for $R^1$, n is from 2 to 6 and m is from 1 to 6.

27. The method of claim 23, wherein the composition further comprises a copolymer comprising as monomers ethylene and from 6 to 21 mol % of a compound selected from the group consisting of a vinyl ester, an acrylic ester, a methacrylic ester, an alkyl vinyl ester, and mixtures thereof, and optionally an alkene.

28. The method of claim 23, wherein the composition further comprises a reaction product of a compound of the formula $NR^6R^7R^8$, where $R^6$, $R^7$ and $R^8$ may be the same or different and at least one of these groups is $C_8$-$C_{36}$-alkyl, $C_6$-$C_{36}$-cycloalkyl, $C_8$-$C_{36}$-alkenyl, and the remaining groups are either hydrogen, $C_1$-$C_{3-6}$-alkyl, $C_2$-$C_{36}$-alkenyl, cyclohexyl, or a group of the formulae $-(A\text{-}O)_x\text{-}E$ or $—(CH_2)_n—NYZ$, where A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$ with compounds which have a functional group of the formula

>C=O.

29. The method of claim 17, wherein the composition further comprises a comb polymer of the formula

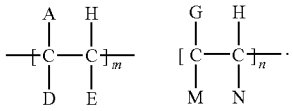

where

A is R', COOR', OCOR', R"—COOR', OR';

D is H, $CH_3$, A or R";

E is H, A;

G is H, R", R"-COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

30. The method of claim 23, wherein the composition further comprises a polyoxyalkylene compound selected from the group consisting of an ester, an ether, an ester/ether, and mixtures thereof, said compound having at least one alkyl radical having from 12 to 30 carbon atoms.

31. The method of claim 23, wherein the composition further comprises a copolymer comprising structural units of ethylene, structural units which derive from α-olefins having from 3 to 24 carbon atoms and having a molecular weight of up to 120 000 g/mol.

* * * * *